US006239098B1

(12) United States Patent
Matsumura et al.

(10) Patent No.: US 6,239,098 B1
(45) Date of Patent: May 29, 2001

(54) WATER-REPELLENT DETERGENT

(75) Inventors: Kazuyuki Matsumura; Akira Yamamoto, both of Usui-gun (JP)

(73) Assignee: Shin-Etsu Chemical Co., Ltd., Tokyo (JP)

( * ) Notice: Subject to any disclaimer, the term of this patent is extended or adjusted under 35 U.S.C. 154(b) by 0 days.

(21) Appl. No.: 08/999,950

(22) Filed: May 20, 1997

(30) Foreign Application Priority Data

May 21, 1996 (JP) ..... 8-150009

(51) Int. Cl.[7] ..... C11D 3/30
(52) U.S. Cl. ..... 510/466
(58) Field of Search ..... 556/413, 423, 556/425, 443; 510/466

(56) References Cited

U.S. PATENT DOCUMENTS 3,772,346 * 11/1973 Hess ..... 260/448.8 R
5,274,159 * 12/1993 Pellerite et al. ..... 556/485

FOREIGN PATENT DOCUMENTS 5-341288 * 12/1993 (JP) .
5-331455 * 7/1995 (JP) .
7-179761 * 7/1995 (JP) .

* cited by examiner

*Primary Examiner*—John Hardee
(74) *Attorney, Agent, or Firm*—Millen White Zelano & Branigan

(57) ABSTRACT

By reacting (A) a fluorinated alkyl group-containing alkoxysilane or a mixture of a fluorinated alkyl group-containing alkoxysilane and a fluorine-free monovalent hydrocarbon group-containing alkoxysilane with (B) an amino group-containing alkoxysilane, there is obtained a water-soluble reaction product which is useful as an active ingredient of a water-repellent detergent. The detergent is effective as a water-repellent window wash liquid for automobiles.

10 Claims, No Drawings

WATER-REPELLENT DETERGENT

BACKGROUND OF THE INVENTION

1. Field of the Invention

This invention relates to a water-repellent detergent, especially suited as a water-repellent window wash liquid for automobiles.

2. Prior Art

Water-repellent detergents as typified by water-repellent window wash liquids for automobiles are commercially available as automotive chemical parts. Such wash liquids function not only to clean windshields, but also to impart water repellency thereto. Commercial products include Linda by Yokohama Yushi K. K., Glaco Washer Liquid by Soft 99 K. K., and Amenbo Washer by CCI K. K. Since these water-repellent window wash liquids contain polydimethylsiloxane, polymethylphenylsiloxane or amino-modified siloxane as a water-repellent component, they spread water-repellent films which form little or very weak chemical bond with the surface of a substrate to be cleaned and hence, do not durably last. Also the initial water repellency is weak since the basic skeleton of such siloxane is a hydrocarbon chain.

JP-A 179850/1995 discloses a wash liquid comprising a product resulting from hydrolysis of a fluoroalkylsilane with hydrochloric acid or nitric acid. Its initial water repellency is enough since the water-repellent component is a fluoroalkyl group. However, the wash liquid is less stable since the hydrolysate of fluoroalkylsilane is essentially water insoluble. The use of strong acid such-as hydrochloric acid and nitric acid leaves a possibility that rubber blades and painted surfaces of wipers be damaged or corroded.

SUMMARY OF THE INVENTION

Therefore, an object of the present invention is to provide a novel and improved water-repellent detergent which has a satisfactory cleaning ability and forms a durably water repellent film and which is fully shelf stable and less corrosive in solution form.

We have found that a water-soluble reaction product obtained by co-hydrolysis and condensation of (A) a fluorinated alkyl group-containing alkoxysilane and optionally, a fluorine-free monovalent hydrocarbon group-containing alkoxysilane with (B) an amino group-containing alkoxysilane is useful as an active ingredient of a water-repellent detergent. Since the reaction product is in the form that a fluorinated alkyl group-containing silane compound serving as a water-repellent component is given water solubility, it is well soluble in water. Then the detergent is fully shelf stable. Additionally, the detergent imparts high water repellency which lasts long. Since a weak acid is used in co-hydrolysis, corrosive property can be suppressed. Water repellency can be exerted merely by admixing the reaction product in a detergent liquid containing a cleansing component. There is obtained a water-repellent detergent which has eliminated many of the problems of prior art water-repellent detergents.

According to the invention, there is provided a water-repellent detergent comprising a cleansing component and as an active ingredient a water-soluble reaction product obtained by co-hydrolysis and condensation of (A) a fluorinated alkyl group-containing alkoxysilane with (B) an amino group-containing alkoxysilane. Also useful is a water-soluble reaction product obtained by co-hydrolysis and condensation of (A) a mixture of a fluorinated alkyl group-containing alkoxysilane and a fluorine-free monovalent hydrocarbon group-containing alkoxysilane with (B) an amino group-containing alkoxysilane.

DETAILED DESCRIPTION OF THE INVENTION

The fluorinated alkyl group-containing alkoxysilane used herein as reactant (A) is preferably a silane of the following general formula (1) though not limited thereto.

$$Rf(CH_2)_aX(CH_2)_bSi(R^2_c)(OR^1)_{3-c} \quad (1)$$

Rf is a fluoroalkyl group represented by $C_nF_{2n+1}$ wherein n is an integer of 1 to 20; X is a linking group selected from the group consisting of —$(CH_2)$y——$CH_2O$—, —$NR^3$—, —$CO_2$—, —$CONR^3$—, —S—, —$SO_3$and —$SO_2NR$— and mixtures thereof wherein $R^3$ is hydrogen or an alkyl group having 1 to 8 carbon atoms and letter y is an integer of 1 to 3; $R^1$ is an alkyl group having 1 to 4 carbon atoms; R is an alkyl group having 1 to 4 carbon atoms; letter a is an integer of 0 to 3, b is an integer of 1 to 3, and c is equal to 0 or 1.

More particularly, Rf is $C_nF_{2n+1}$ wherein n is an integer of 1 to 20, for example, $CF_3$—, $C_2F_5$—, $C_3F_7$—, $C_4F_9$—, $C_6F_{13}$—, $C_8F_{17}$—, $C_{10}F_{21}$—, $C_{12}F_{25}$—, $C_{14}F_{29}$—, $C_{16}F_{33}$—, $C_{18}F_{37}$—, and $C_{20}F_{41}$—.

Illustrative, non-limiting, examples of the silane of the general formula (1) are given below.

silanes of formula (1) wherein X=$CH_2$, a=0, and b=1 to 3, that is, silanes of $Rf(CH_2)_xSiR^2_c(OR)_{3-c}$ wherein x is 2 to 4:

$Rf(CH_2)_2Si(OCH_3)_3$,
$Rf(CH_2)_2Si(OC_2H_5)_3$,
$Rf(CH_2)_2Si(OCH(CH_3)_2)_3$,
$Rf(CH_2)_2SiCH_3(OCH_3)_2$,
$Rf(CH_2)_2SiCH_3(OC_2H_5)_2$,
$Rf(CH_2)_2SiCH_3(OCH(CH_3)_2)_2$,
$Rf(CH_2)_3Si(OCH_3)_3$,
$Rf(CH_2)_3SiCH_3(OCH_3)_2$ silanes of formula (1) wherein X=NH and a=0, that is, silanes of $RfNH(CH_2)_bSiR^2_c(OR^1)_{3-c}$:

$RfNH(CH_2)_2Si(OCH_3)_3$,
$RfNH(CH_2)_2Si(OC_2H_5)_3$,
$RfNH(CH_2)_2Si(OCH(CH_3)_2)_3$,
$RfNH(CH_2)_2SiCH_3(OCH_3)_2$,
$RfNH(CH_2)_2SiCH_3(OC_2H_5)_2$,
$RfNH(CH_2)_2SiCH_3(OCH(CH_3)_2)_2$,
$RfNH(CH_2)_3Si(OCH_3)_3$,
$RfNH(CH_2)_3SiCH_3(OCH_3)_2$ silanes of formula (1) wherein X=NH, $(CH_2)$y and NH, and a=0, that is, silanes of $RfNH(CH_2)_yNH(CH_2)_bSiR^2_c(OR^1)_{3-c}$:

$RfNH(CH_2)_2NH(CH_2)_2Si(OCH_3)_3$,
$RfNH(CH_2)_2NH(CH_2)_2Si(OC_2H_5)_3$,
$RfNH(CH_2)_2NH(CH_2)_2Si(OCH(CH_3)2)_3$,
$RfNH(CH_2)2NH(CH_2)_2SiCH_3(OCH_3)_2$,
$RfNH(CH_2)_2NH(CH_2)_2SiCH_3(OC2H_5)_2$
$RfNH(CH_2)_2NH(CH_2)_2SiCH_3(OCH(CH_3)_2)_2$,
$RfNH(CH_2)_2NH(CH_2)_3Si(OCH_3)_3$,
$RfNH(CH_2)_2NH(CH_2)_3SiCH_3(OCH_3)_2$ silanes of formula (1) wherein X=CONH and a=0, that is, silanes of $RfCONH(CH_2)_bSiR^2_c(OR^1)_{3-c}$:

$RfCONH(CH_2)_2Si(OCH_3)_3$, $RfCONH(CH_2)_2Si(OC_2H_5)_3$, $RfCONH(CH_2)_2Si(OCH(CH_3)_2)_3$, $RfCONH\ (CH_2\ )_2SiCH_3\ (OCH_3\ )_2$, $RfCONH(CH_2)_2SiCH_3(OC2H_5)_2$, $Rf\ CONH\ (CH_2)_2SiCH_3\ (OCH\ (CH_3)_2)_2$, $RfCONH(CH_2)_3Si(OCH_3)_3$, $RfCONH(CH_2)_3Si(OCH(CH_3)_2)_3$, $RfCONH\ (CH_2\ )_3SiCH_3(OCH_3\ )_2$ silanes of formula (1) wherein $X=CO_2$ and NH, that is, silanes of $Rf(CH\ _2)_aOCONH(CH_2)_bSiR^2_c(OR^1)_{3-c}$:

$Rf(CH_2)_{20}CONH(CH_2)_2Si(OCH_3)_3$, $Rf(CH_2)_{20}CONH(CH_2)_2Si(OC_2H_5)_3$, $Rf(CH_2)_{20}CONH(CH_2)_2Si(OCH(CH_3)_2)_3$, $Rf(CH_2)_{20}CONH(CH_2)_2SiCH_3(OCH_3)_2$, $Rf(CH_2)_{20}CONH(CH_2)_3Si(OCH_3)_3$, $Rf\ (CH_2)_2OCONH\ (CH_2)_3SiCH_3\ (OCH_3)_2$ silanes of formula (1) wherein $X=SO_2NR$ and a=0, that is, silanes of $RfSO_2NR^3(CH_2)_bSiR^2_c(OR^1)_{3-c}$:

$RfSO_2NH\ (CH_2)_2Si(OCH_3)_3$, $RfSO_2NH\ (CH_2)_2Si(OC_2H_5)_3$, $RfSO_2NH\ (CH_2)_2Si(OCH\ (CH_3)\ 2)_3$, $Rf\ SO_2NH\ (CH_2)_2SiCH_3(OCH_3)_2$, $RfSO_2NH(CH_2)_2SiCH_3(OC_2H_5)_2$, $RfSO_2NH(CH_2)_2SiCH_3(OCH(CH_3)_2)_2$, $RfSO_2NH(CH_2)_3Si(OCH_3)_3$, $RfSO_2NH(CH_2)_3Si(OCH(CH_3)_2)_3$, $RfSO_2NH\ (CH_2)_3SiCH_3\ (OCH_3)_2$, $RfSO_2N(CH_3)\ (CH_2)_2Si(OCH_3)_3$, $RfSO_2N(CH_3)\ (CH_2)_2Si(OCH(CH_3)_2)_3$, $RfSO_2N(CH_3)\ (CH_2)_2SiCH_3(OCH_3)_2$, $RfSO_2N\ (CH_3)\ (CH_2)_2SiCH_3(OC_2H_5)_2$, $RfSO_2N\ (CH_3)\ (CH_2)_2SiCH_3(OCH\ (CH_3)_2)_2$, $RfSO_2N(CH_3)\ (CH_2)_3Si(OCH_3)_3$, $RfSO_2N\ (CH_3)\ (CH_2)_3SiCH_3\ (OCH_3)_2$ silanes of formula (1) wherein $X=SO_2$, NH, $(CH_2)_y$ and CONH and a=0, that is, silanes of $RfSO_2NH(CH_2)_yCONH(CH_2)_bSiR^2_c(OR^1)_{3-c}$:

$RfSO_2NH\ (CH_2)_2CONH(CH_2)_3Si\ (OCH_3)_3$, $RfSO_2NH\ (CH_2)_2CONH\ (CH_2)\ _3Si\ (OC_2H_5)\ _3$, $RfSO_2NH(CH_2)_2CONH\ (CH_2)_3Si\ (OCH(CH_3)_2)_3$, $RfSO_2NH\ (CH_2\ )_2CONH\ (CH_2\ )\ 3SiCH_3\ (OCH_3\ )_2$, $RfSO_2NH\ (CH_2)_3CONH\ (CH_2)_3Si\ (OCH_3)_3$, $RfSO_2NH\ (CH_2)_3CONH\ (\ CH_2)\ 3SiCH_3\ (OCH_3)_2$

Preferred among these are those silanes having a $C_8F_{17}$ group, for example, $C_8F_{17}(CH_2)_2Si(OCH_3)_3$, $C_8F_{17}(CH_2)_2Si(OC_2H_5)_3$, and $C_8F_{17}CONH(CH_2)_2Si(OCH_3)_3$. Especially preferred is $C_8F_{17}(CH_2)_2Si\ (OCH_3)_3$.

In the practice of the invention, not only the aforementioned silanes, but also partial hydrolysates thereof are useful as the fluorinated alkyl group-containing alkoxysilane. The partial hydrolysate must have at least one hydrolyzable group left therein. If desired, a mixture of such silanes is employed as well as a partial hydrolysate of a mixture of silanes.

The amino group-containing alkoxysilane used herein as reactant (B) is preferably a silane of the following general formula (2) though not limited thereto.

(2)

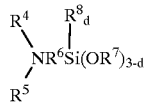

Each of $R^4$ and $R^5$ which may be identical or different, is hydrogen, an alkyl group having 1 to 15 carbon atoms, preferably 1 to 4 carbon atoms or an aminoalkyl group having 1 to 15 carbon atoms, preferably 1 to 6 carbon atoms; $R^6$ is a divalent hydrocarbon group having 1 to 18 carbon atoms, preferably 1 to 6 carbon atoms, for example, alkylene, arylene and alkylarylene groups; $R^7$is an alkyl group having 1 to 4 carbon atoms; $R^8$ is an alkyl group having 1 to 4 carbon atoms; and letter d is equal to 0 or 1.

Illustrative, non-limiting, examples of the amino group-containing alkoxysilane of the general formula (2) are given below.

$H_2N(CH_2)_2Si(OCH_3)_3$, $H_2N\ (CH_2)_2Si(OC_2H_5)_3$, $H_2N(CH_2)_3Si(OCH_3)_3$, $H_2N(CH_2)_3Si(OC_2H_5)_3$, $CH_3NH(CH_2)_3Si(OCH_3)_3$, $CH_3NH(CH_2)_3Si(OC_2H_5)_3$, $CH_3NH(CH_2)_2Si(OCH_3)_3$, $CH_3NH(CH_2)_2Si(OC_2H_5)_3$, $H_2N(CH_2)_2NH(CH_2)_3Si(OCH_3)_3$, $H_2N(CH_2)_2NH(CH_2)_3Si(OC_2H_5)_3$, $CH_3NH(CH_2)_2NH(CH_2)_3Si(OCH_3)_3$, $CH_3NH(CH_2)_2NH(CH_2)_3Si(OC_2H_5)_3$, $C_4H_9NH(CH_2)_2NH(CH_2)_3Si(OCH_3)_3$, $C_4H_9NH\ (CH_2)_2NH\ (CH_2)_3Si(OC_2s)_3$, $H_2N(CH_2)_2SiCH_3(OCH_3)_2$, $H_2N(CH_2)_2SiCH_3(OC2H_5)_2$, $H_2N(CH_2)_3SiCH_3(OCH_3)_2$, $CH_3NH(CH_2)_3SiCH_3(OCH_3)_2$, $CH_3NH(CH_2)_5SiCH_3(OCH_3)_2$, $H_2N(CH_2)_2NH\ (CH_2)_3SiCH_3(OCH_3)_2$, $CH_3NH(CH_2)_2NH(CH_2)_3SiCH_3(OCH_3)_2$, $C_4H_9NH(CH_2)_2NH(CH_2)_3SiCH_3(OCH_3)_2$

Among these, the following compounds are especially preferred.

$H_2N(CH_2)_3Si(OCH_3)_3$, $H_2N(CH_2)_3Si(OC_2H_5)_3$, $H_2N(CH_2)_2NH(CH_2)_3Si(OCH_3)_3$, $H_2N(CH_2)_2NH\ (CH_2)_3SiCH_3(OCH_3)_2$

In the practice of the invention, not only the aforementioned silanes, but also partial hydrolysates thereof are useful as the amino group-containing alkoxysilane.

According to the invention, a co-hydrolysis/condensation reaction product of fluorinated alkyl group-containing alkoxysilane (A) and amino group-containing alkoxysilane (B) is used. If desired, a co-hydrolysis/condensation reaction product of these silanes combined with a fluorine-free monovalent hydrocarbon group-containing alkoxysilane can be used.

The fluorine-free monovalent hydrocarbon group-containing alkoxysilane used herein is preferably of the following general formula (3) though not limited thereto.

(3)

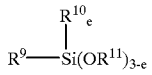

$R^9$ is a fluorine-free monovalent hydrocarbon group having 1 to 10 carbon atoms; $R^{10}$ is an alkyl group having 1 to 4 carbon atoms; $R^{11}$ is an alkyl group having 1 to 4 carbon atoms; and letter e is equal to 0 or 1. Examples of the monovalent hydrocarbon group include alkyl, alkenyl, aryl, aralkyl groups and these groups substituted with halogen other than fluorine, with the alkyl groups being preferred.

Illustrative, non-limiting, examples of the alkoxysilane are given below.

$C_{10}H_{21}Si(OCH_3)_3$,
$C_{10}H_{21}Si(OC_2H_5)_3$,
$C_{10}H_{21}Si(OCH(CH_3)_2)_3$,
$C_{10}H_{21}Si(CH_3)(OCH_3)_2$,
$C_{10}H_{21}Si(CH_3)(OC_2H_5)_2$,
$C_8H_{17}Si(OCH_3)_3$,
$C_8H_{17}Si(OC_2H_5)_3$,
$C_8H_{17}Si(OCH(CH_3)_2)_3$,
$C_8H_{17}Si(CH_3)(OCH_3)_2$,
$C_6H_{13}Si(OCH_3)_3$,
$C_6H_1Si(OC_2H_5)_3$,
$C_6H_{13}Si(CH_3)(OCH_3)_2$,
$C_4H_9Si(OCH_3)_3$,
$C_4H_9(OC_2H_5)_3$,
$C_4H_9Si(CH_3)(OCH_3)_2$,
$C_3H_7Si(OCH_3)_3$,
$C_3H_7Si(OC_2H_5)_3$,
$C_3H_7Si(CH_3)(OCH_3)_2$,
$C_2H_5Si(OCH_3)_3$,
$C_2H_5Si(OC_2H_5)_3$,
$C_2H_5Si(CH_3)(OCH_3)_2$,
$CH_3Si(OCH_3)_3$,
$CH_3Si(OC_2H_5)_3$,
$CH_3Si(OCH(CH_3)_2)_3$,
$(CH_3)_2Si(OCH_3)_2$,
$(CH_3)_2Si(OC2H_5)_2$

Preferred among these are $C_{10}H_{21}Si(OCH_3)_3$, $C_{10}H_{21}Si(CH_3)(OCH_3)_2$, $(CH_3)_2Si(OCH_3)_2$, and $(CH_3)_2Si(OC_2H_5)_2$.

In the practice of the invention, not only the aforementioned silanes, but also partial hydrolysates thereof are useful as the monovalent hydrocarbon group-containing alkoxysilane.

The reaction product of the fluorinated alkyl group-containing alkoxysilane and amino group-containing alkoxysilane or the reaction product of the fluorinated alkyl group-containing alkoxysilane, monovalent hydrocarbon group-containing alkoxysilane, and amino group-containing alkoxysilane can be obtained by subjecting these two or three reactants to co-hydrolysis and condensation in the presence of water and an organic or inorganic acid. From the standpoint of stability, it is preferred to obtain the reaction product by first partially hydrolyzing the fluorinated alkyl group-containing alkoxysilane or a mixture of the fluorinated alkyl group-containing alkoxysilane and monovalent hydrocarbon group-containing alkoxysilane in the presence of an organic or inorganic acid and then reacting the partial hydrolysate of the fluorinated alkyl group-containing alkoxysilane or the partial hydrolysate of the fluorinated alkyl group-containing alkoxysilane and monovalent hydrocarbon group-containing alkoxysilane with the amino group-containing alkoxysilane.

The organic or inorganic acid which is used in hydrolysis of the fluorinated alkyl group-containing alkoxysilane alone or a mixture of the fluorinated alkyl group-containing alkoxysilane and monovalent hydrocarbon group-containing alkoxysilane may be selected from hydrochloric acid, sulfuric acid, methanesulfonic acid, formic acid, acetic acid, propionic acid, citric acid, oxalic acid, and maleic acid and mixtures thereof. Use of weak acids is preferred from the standpoint of the attack of the reaction product to a substrate to be treated therewith. Acetic acid and propionic acid are especially preferred. An appropriate amount of the acid used is about 5 to 400 parts, especially about 10 to 150 parts by weight per 100 parts by weight of the fluorinated alkyl group-containing alkoxy-silane alone or combined with the monovalent hydrocarbon group-containing alkoxysilane. Less than 5 parts of the acid would be ineffective for promoting hydrolysis and result in a reaction product, an aqueous solution of which is less stable.

On hydrolysis, the reactants are preferably diluted with a solvent. Suitable solvents are alcoholic solvents such as methanol, ethanol, 1-propanol, 2-propanol, 1-butanol, 2-butanol, 3-butanol and 2-methyl-2-butanol, with the 3-butanol being especially preferred. An appropriate amount of the solvent used is about 100 to 500 parts, especially about 200 to 400 parts by weight per 100 parts by weight of the fluorinated alkyl group-containing alkoxy-silane alone or combined with the monovalent hydrocarbon group-containing alkoxysilane. Less than 100 parts of the solvent would allow condensation to proceed too rapidly whereas more than 500 parts of the solvent would retard hydrolysis, taking an undesirably longer time.

Water is added for hydrolysis of the fluorinated alkyl group-containing alkoxysilane alone or a mixture of the fluorinated alkyl group-containing alkoxysilane and monovalent hydrocarbon group-containing alkoxysilane. An appropriate molar amount of water is 1 to 3 times, preferably 1.2 to 2.5 times the moles of the fluorinated alkyl group-containing alkoxysilane alone or the total moles of the fluorinated alkyl group-containing alkoxysilane and monovalent hydrocarbon group-containing alkoxysilane. If the amount of water is less than a molar equivalent amount, more alkoxy groups would be left. If the amount of water is more than a triple molar amount, condensation would proceed too rapidly.

Reaction conditions for hydrolysis of the fluorinated alkyl group-containing alkoxysilane alone or a mixture of the fluorinated alkyl group-containing alkoxysilane and monovalent hydrocarbon group-containing alkoxysilane include a temperature of 10 to 100° C., preferably 60 to 90° C. and a time of about 1 to 3 hours.

Where a mixture of alkoxysilanes is hydrolyzed, the mixture preferably contains the fluorinated alkyl group-containing alkoxysilane and the monovalent hydrocarbon group-containing alkoxysilane in a molar ratio of from 1:0.05 to 1:0.5. If the molar ratio of monovalent hydrocarbon group-containing alkoxysilane is less than 0.05, durability would be exacerbated. If the molar ratio of monovalent hydrocarbon group-containing alkoxysilane is more than 0.5, water solubility and oil repellency would be exacerbated.

Next, the partial hydrolysate of fluorinated alkyl group-containing alkoxysilane or the reaction product of fluorinated alkyl group-containing alkoxysilane and monovalent hydrocarbon group-containing alkoxysilane obtained as above is reacted with the amino group-containing alkoxysilane without interruption. The hydrolysate of fluorinated alkyl group-containing alkoxysilane or the reaction product of fluorinated alkyl group-containing alkoxysilane and monovalent hydrocarbon group-containing alkoxysilane is reacted with the amino group-containing alkoxysilane in a molar ratio of from 1:0.5 to 1:20. If the molar ratio of amino group-containing alkoxysilane is less than 0.5, the final reaction product would be less water soluble. If the molar ratio of amino group-containing alkoxysilane is more than 20, the final reaction product would be less water repellent.

Preferred conditions for reaction of the amino group-containing alkoxysilane include a temperature of 60 to 100° C. and a time of about 1 to 3 hours. The catalyst is the same as previously mentioned.

The thus obtained co-hydrolysis/condensation product is water soluble. The present invention employs this water-soluble reaction product as an active ingredient, that is, water-repellent, cleansing ingredient. More particularly, a water-repellent detergent according to the invention is obtained by dissolving the water-soluble reaction product in a detergent liquid containing a cleansing component. The concentration of the water-soluble reaction product may be properly determined although it is preferably 0.01 to 1% by weight, more preferably 0.05 to 0.2% by weight of the overall detergent. Less than 0.01% of the water-soluble reaction product would be too small to provide water repellency whereas more than 1% of the water-soluble reaction product would cause corrosion and staining. It is understood that the cleansing component may be selected from a variety of surfactants including cationic, anionic and nonionic surfactants. Cationic surfactants include tetraalkylammonium chlorides and imidazolinium methosulfates. Anionic surfactants include alkyl sulfate salts, alkyl ether sulfate salts, α-sulfofatty acid methyl esters, α-olefin sulfonic acid salts, alkane sulfonic acid salts, alkylbenzenesulfonic acid salts, and N-methyl-N-acyltaurines. Nonionic surfactants include primary alcohol ethoxylates, secondary alcohol ethoxylates, alkyl phenyl polyoxyethylene ethers, fatty acid ethanol amides, and amine oxides. Among these, cationic surfactants are preferred. An appropriate amount of the surfactant is 0.01 to 1% by weight, more preferably 0.05 to 0.3% by weight of the overall detergent. Less than 0.01% of the surfactant would be too small to provide cleansing effect whereas more than 1% of the surfactant would detract from water repellency of the detergent.

There may be further contained additives such as glycol, solvents such as methanol and ethanol, anti-rusting agents, coloring agents, and the like. Detergent liquids containing such cleansing and other components may be well-known detergent liquids, typically commercially available automotive washer liquids and shampoo liquids.

The water-repellent detergent of the invention is advantageously applicable to window glass, mirrors and painted surfaces of vehicles, ships, aircraft and buildings to impart water repellent, oil repellent, stain-proof and anti-icing actions as well as cleaning action. The detergent is especially suited as automotive water-repellent window washer liquid and automotive water-repellent shampoo liquid.

EXAMPLE

Examples of the invention are given below by way of illustration and not by way of limitation.

Synthesis Example 1

A 0.5-liter four-necked flask equipped with a stirrer, condenser, thermometer and dropping funnel was charged with 50.0 grams (0.088 mol) of $C_8H_{17}(CH_2)_2Si(OCH_3)_3$, 170 grams of 3-butanol, 13.2 grams (0.22 mol) of acetic acid, and 2.4 grams (0.133 mol) of water. The contents were stirred and heated to start refluxing of 3-butanol. Reaction was continued for 2 hours whereupon 19.6 grams (0.088 mol) of $H_2N(CH_2)_2HN(CH_2)_3Si(OCH_3)_3$ was added dropwise through the dropping funnel. Reaction was continued for 1 hour under reflux of 3-butanol, yielding a pale yellow clear solution. Upon heating at 105° C. for 3 hours, a nonvolatile content of 20.3% was determined.

Synthesis Example 2

A 0.5-liter four-necked flask equipped with a stirrer, condenser, thermometer and dropping funnel was charged with 48.0 grams (0.085 mol) of $C_8,H_{17}(CH_2)_2Si(OCH_3)_3$, 2.0 grams (0.009 mol) of $(CH_3)_2Si(OCH_3)_2$, 169 grams of 3-butanol, 14.2 grams (0.237 mol) of acetic acid, and 2.6 grams (0.142 mol) of water. The contents were stirred and heated to start refluxing of 3-butanol. Reaction was continued for 2 hours whereupon 21.0 grams (0.095 mol) of $H_2N(CH_2)_2HN(CH_2)_3Si(OCH_3)_3$ was added dropwise through the dropping funnel. Reaction was continued for 1 hour under reflux of 3-butanol, yielding a pale yellow clear solution. Upon heating at 105° C. for 3 hours, a nonvolatile content of 20.2% was determined.

Synthesis Example 3

The procedure of Synthesis Example 2 was repeated except that 8.6 grams (0.143 mol) of acetic acid was used and 17.0 grams (0.095 mol) of $H_2N(CH_2)_3Si(OCH_3)_3$ was used instead of $H_2N(CH_2)_2HN(CH_2)_3Si(OCH_3)_3$. The resulting clear solution was determined for a nonvolatile content by heating at 105° C. for 3 hours, finding 20.4%.

Synthesis Example 4

A 0.5-liter four-necked flask equipped with a stirrer, condenser, thermometer and dropping funnel was charged with 150 grams of isopropyl alcohol, 3.0 grams (0.005 mol) of $C_8H_{17}(CH_2)_2Si(OCH_3)_3$, 1.0 gram (0.016 mol) of nitric acid, and 0.2 gram of water. The contents were stirred and heated to 80° C. The contents were heated under reflux for 3 hours and then cooled, yielding a clear solution. Upon heating at 105° C. for 3 hours, a nonvolatile content of 1.8% was determined.

Example 1

A water-repellent detergent was prepared by blending 2 grams of the reaction product solution of Synthesis Example 1 in 498 grams of a detergent liquid consisting of 0.08% by weight of lauryltrimethylammonium chloride, 0.1% by weight of ethylene glycol, 25% by weight of methanol and the balance of water. The water-repellent detergent was allowed to stand for one month at 50° C., and it remained unchanged.

A droplet of this water-repellent detergent was applied to a cold rolled steel sheet, which was observed for rust. Faint rust was found after 2 or 3 days.

A glass plate of 70 mm×150 mm×3 mm thick was furnished. Using a commercially available degreasing agent, an oil film was completely removed from the glass plate. Six droplets of the water-repellent detergent were pipetted on the glass plate, which was wiped 30 strokes with gauze. This sample was evaluated for water repellency by carrying out the following tests. The results are shown in Table 1.

(a) Contact Angle

A contact angle of the sample with water was measured. Measurement was done at five different points on the sample surface. With the maximum and minimum cut off, an average of three measurements was calculated.

(b) Abrasion Test

Using a scratching tester (by KNT K. K.), an abrasion test was carried out by abrading the sample with fabric under a load of 1 kg/cm$^2$ over 3,000 cycles. Thereafter, a contact angle with water was measured as in (a).

An automotive window washer tank was filled with the water-repellent detergent. While the wiper was operated, the detergent was sprayed onto the windshield for forming a water-repellent film. The initial contact angle was measured as in (a). The durability of the water-repellent film on an actual automobile was evaluated in terms of the number of days passed until the contact angle lowered to less than 100°. The results of the water repellency test are shown in Table 2.

Also, the water-repellent detergent was applied to a painted surface of an automobile, which was observed for staining. No stains were found.

Example 2

A water-repellent detergent was prepared by blending 2 grams of the reaction product solution of Synthesis Example 2 in 498 grams of a detergent liquid consisting of 0.08% by weight of lauryltrimethylammonium chloride, 0.1% by weight of ethylene glycol, 25% by weight of methanol and the balance of water. The water-repellent detergent was allowed to stand for one month at 50° C., and it remained unchanged.

A droplet of this water-repellent detergent was applied to a cold rolled steel sheet, which was observed for rust; Faint rust was found after 2 or 3 days.

A sample of glass plate having the water-repellent detergent applied thereto was prepared and tested as in Example 1. The results are shown in Table 1.

As in Example 1, the water-repellent detergent was applied to an automotive windshield, and the initial contact angle and durability of water-repellent film were determined. The results are shown in Table 2.

Also, the water-repellent detergent was applied to a painted surface of an automobile, which was observed for staining. No stains were found.

Example 3

A water-repellent detergent was prepared by blending 2 grams of the reaction product solution of Synthesis Example 3 in 498 grams of a detergent liquid consisting of 0.08% by weight of lauryltrimethylammonium chloride, 0.1% by weight of ethylene glycol, 25% by weight of methanol and the balance of water. The water-repellent detergent was allowed to stand for one month at 50° C., and it remained unchanged.

A droplet of this water-repellent detergent was applied to a cold rolled steel sheet, which was observed for rust. Faint rust was found after 2 or 3 days.

A sample of glass plate having the water-repellent detergent applied thereto was prepared and tested as in Example 1. The results are shown in Table 1.

As in Example 1, the water-repellent detergent was applied to an automotive windshield, and the initial contact angle and durability of water-repellent film were determined. The results are shown in Table 2.

Also, the water-repellent detergent was applied to a painted surface of an automobile, which was observed for staining. No stains were found.

Comparative Example 1

A water-repellent detergent was prepared by blending 22 grams of the reaction product solution of Synthesis Example 4 in 478 grams of a detergent liquid consisting of 0.08% by eight of lauryltrimethylammonium chloride, 0.1% by weight of ethylene glycol, 25% by weight of methanol and the balance of water. The water-repellent detergent was allowed to stand for one month at 50° C., and a trace amount of precipitate was found.

A droplet of this water-repellent detergent was applied to a cold rolled steel sheet, which was observed for rust. Rust was found after about one hour.

A sample of glass plate having the water-repellent detergent applied thereto was prepared and tested as in Example 1. The results are shown in Table 1.

As in Example 1, the water-repellent detergent was applied to an automotive windshield, and the initial contact angle and the durability of a water-repellent film were determined. The results are shown in Table 2.

Also, the water-repellent detergent was applied to a painted surface of an automobile, which was observed for staining. Some stains were found.

Comparative Example 2

A water-repellent detergent was prepared by diluting a commercially available automotive water-repellent window washer replenisher (trade name Linda by Yokohama Yushi K. K.) with water to a total amount of 500 grams. The water-repellent detergent was allowed to stand for one month at 50° C., and a trace amount of precipitate was found.

A droplet of this water-repellent detergent was applied to a cold rolled steel sheet, which was observed for rust. Rust was found after about 30 minutes.

A sample of glass plate having the water-repellent detergent applied thereto was prepared and tested as in Example 1. The results are shown in Table 1.

As in Example 1, the water-repellent detergent was applied to an automotive windshield, and the initial contact angle and the durability of a water-repellent film were determined. The results are shown in Table 2.

Also, the water-repellent detergent was applied to a painted surface of an automobile, which was observed for staining. Some stains were found.

TABLE 1

| | Contact angle (°) | |
|---|---|---|
| | Initial | After abrasion test |
| Example 1 | 110 | 109 |
| Example 2 | 110 | 110 |
| Example 3 | 111 | 110 |
| Comparative Example 1 | 105 | 97 |
| Comparative Example 2 | 81 | 71 |

TABLE 2

| | Initial contact angle | Durability |
|---|---|---|
| Example 1 | 110° | 6 months |
| Example 2 | 110° | 7 months |

TABLE 2-continued

| | Initial contact angle | Durability |
|---|---|---|
| Example 3 | 103° | 7 months |
| Comparative Example 1 | 103° | 3 months |
| Comparative Example 2 | 80° | 1 month |

There has been described a water-repellent detergent which has a satisfactory cleaning ability, imparts water repellency and forms a durably water repellent film. Additionally the detergent is fully shelf stable and less corrosive in solution form. The water-repellent detergent of the invention is advantageously applicable to window glass, mirrors and painted surfaces of vehicles, ships, aircraft and buildings and especially suited as automotive water-repellent window washer fluid.

Japanese Patent Application No. 150009/1996 is incorporated herein by reference.

Although some preferred embodiments have been described, many modifications and variations may be made thereto in the light of the above teachings. It is therefore to be understood that within the scope of the appended claims, the invention may be practiced otherwise than as specifically described.

What is claimed is:

1. A water-repellent detergent comprising a cleansing component and as an active ingredient a water-soluble reaction product obtained by co-hydrolysis and condensation of (A) a fluorinated all group-containing alkoxysilane or a mixture of a fluorinated alkyl group-containing alkoxysilane and a fluorine-free monovalent hydrocarbon group-containing a alkoxysilane with (B) an amino group-containing alkoxysilane, wherein the fluorinated alkyl group-containing alkoxysilane is a silane of the following formula (1):

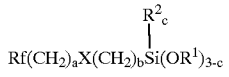

wherein Rf is a fluoroalkyl group represented by $C_nF_{2u°1}$ wherein n is an integer of 1 to 20, X is a linking group selected from the group consisting of wherein the letter y is an integer of 1to 3, $R^1$ is an alkyl group having 1 to 4 carbon atoms, $R^2$ is an alkyl group having 1 to 4 carbon atoms, letter a is an integer of 0 to 3, b is an integer of 1 to 3, and c is equal to 0 to 1, or a partial hydrolysate thereof, the amino group-containing alkoxysilane is a silane of the following formula (2):

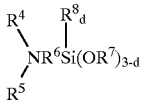

wherein $R^4$ and $R^5$ are independently selected from the group consisting of hydrogen, an alkyl group having 1 to 15 carbon atoms, and an aminoalkyl group having 1 to 15 carbon atoms, $R^6$ is a divalent hydrocarbon group having 1 to 18 carbon atoms, $R^7$ is an alkyl group having 1 to 4 carbon atoms, $R^8$ is an alkyl group having 1 to 4 carbon atoms, and letter d is equal to 0 or 1, or a partial hydrolysate thereof, and the fluorine-free monovalent hydrocarbon group-containing alkoxysilane is a silane of the following formula (3):

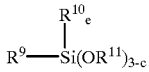

wherein $R^9$ is a fluorine-free monovalent hydrocarbon group having 1 to 10 carbon atoms, $R^{10}$ is an alkyl group having 1 to 4 carton atoms, $R^{11}$ is an alkyl group having 1 to 4 carbon atoms, and letter e is equal to 0 or 1, or a partial hydrolysate thereof.

2. The water-repellent detergent of claim 1 wherein the water-soluble reaction product is obtained by reacting (A) a fluorinated alkyl group-containing alkoxysilane or a mixture of a fluorinated alkyl group-containing alkoxysilane and a fluorine-free monovalent hydrocarbon group-containing alkoxysilane in a molar ratio of from 1:0.05 to 1:0.5 with (B) an amino group-containing alkoxysilane in a molar ratio of from 1:0.5 to 1:20.

3. The water-repellent detergent of claim 1 wherein the cleansing component is at least one surfactant selected from the group consisting of cationic, anionic and nonionic surfactants.

4. The water-repellent detergent of claim 1 wherein the amount of the cleansing component is 0.01 to 1% by weight of the overall detergent and the amount of the water-soluble reaction product is 0.01 to 1% by weight of the overall detergent.

5. The water-repellent detergent of claim 1 which is a water-repellent window wash liquid for automobiles.

6. A water-repellent detergent according to claim 1, which comprises at least one fluorinated alkyl-group containing alkoxysilane of the formula (1) wherein Rf is a $C_8R_{17}$ group.

7. A water-repellent detergent according to claim 1, which comprises at least one amino group-containing alkoxysilane of one of the following formulae:

$H_2N(CH_2)_2Si(OCH_4)_3$, $H_2N(CH_2)_2Si(OCH_2H_5)_3$, $H_2N(CH_2)_3Si(OCH_3)_3$, $H_2N(CH_2)_3Si(OCH_3)_3$, $CH_3NH(CH_2)_3Si(OCH_3)_3$, $CH_3NH(CH_2)_3Si(OC_2H_3)_3$, $CH_3NH(CH_2)_5Si(OC_2H_3)_3$, $CH_3NH(CH_2)_5Si(OC_2H_2)_3$, $H_2N(CH_2)_3NH(CH_2)_3Si(OCH_2)_3$, $H_2N(CH_2)_2NH(CH_2)_3Si(OC_2H_5)_3$, $CH_3NH(CH_2)_2NH(CH_2)_3Si(OCH_3)_3$, $CH_3NH(CH_2)_2NH(CH_2)_3Si(OCH_3)_3$, $C_4H_9NH(CH_2)_2NH(CH_2)_3Si(OCH_3)_3$, $C_4H_9NH(CH_2)_2NH(CH_2)_3Si(OC_2H_5)_3$, $H_2N(CH_2)_3SiCH_3(OCH_3)_2$, $H_2N(CH_2)_2SiCH_3(OC_3H_5)_3$, $H_2N(CH_2)_3SiCH_3(OCH_3)_2$, $CH_3NH(CH_2)_3SiCH_3(OCH_3)_2$, $CH_3NH(CH_2)_5SiCH_3(OCH_3)_2$, $H_2N(CH_2)_2NH(CH_2)_3SiCH_3(OCH_3)_2$, $CH_3NH(CH_2)_2NH(CH_2)_3SiCH_3(OCH_3)_2$, $C_4H_9NH(CH_2)_2NH(CH_2)_3SiCH_3(OCH_3)_2$.

8. A water-repellent detergent according to claim 1, which comprises at least one fluorine-free monovalent hydrocarbon group-containing alkoxysilane.

9. A water repellent detergent according to claim 1, wherein at least one fluorine-free monovalent hydrocarbon group-containing alkoxysilane has an alkyl group of 1 to 10 carbon atoms.

10. A water-repellent detergent according to claim 1, wherein the at least one fluorine-free monovalent hydrocarbon group-containing alkoxysilane is $C_{10}H_{21}Si(OCH_3)_3$, $C_{10}H_{21}Si(H_3)(OCH_3)_2$, $(CH_3)_2Si(OCH_3)_2$, and $(CH_3)_2Si(OD_2H_3)_2$.

* * * * *